US012290183B2

(12) United States Patent
Robinson-Platz

(10) Patent No.: US 12,290,183 B2
(45) Date of Patent: May 6, 2025

(54) TRAVEL PILLOW FOR RESTING THE HEAD UPON THE CHEST

(71) Applicant: Denise Robinson-Platz, Cambria, CA (US)

(72) Inventor: Denise Robinson-Platz, Cambria, CA (US)

( * ) Notice: Subject to any disclaimer, the term of this patent is extended or adjusted under 35 U.S.C. 154(b) by 263 days.

(21) Appl. No.: 17/862,304

(22) Filed: Jul. 11, 2022

(65) Prior Publication Data

US 2022/0346553 A1 Nov. 3, 2022

(51) Int. Cl.
*A47C 7/38* (2006.01)

(52) U.S. Cl.
CPC ..... *A47C 7/383* (2013.01)

(58) Field of Classification Search
CPC .. A47C 7/36; A47C 7/38; A47C 7/383; A47G 9/10; A47G 9/1009; A47G 9/1045; A47G 9/1054; A47G 9/1063; A47G 9/1072; A47G 9/1081; A47G 9/109; A47G 2009/1018
See application file for complete search history.

(56) References Cited

U.S. PATENT DOCUMENTS 3,604,026 A * 9/1971 Scheips ..... A47C 7/383 5/640
4,754,511 A * 7/1988 Sargent ..... A61F 5/01 5/655.4
5,029,577 A * 7/1991 Sarkozi ..... A61F 5/055 602/18
5,044,026 A * 9/1991 Matthews ..... A47G 9/1054 5/644
5,054,854 A * 10/1991 Pruit ..... A47C 7/383 297/284.6
6,435,617 B1 * 8/2002 McNair ..... A47C 7/383 297/397
7,578,014 B1 * 8/2009 Rodriguez ..... A47G 9/0253 5/639
7,832,802 B2 * 11/2010 Ehlers ..... A47C 7/38 297/393
8,382,692 B1 * 2/2013 Chao ..... A47C 7/383 602/17
8,875,330 B2 * 11/2014 Wallace ..... B60N 2/2884 5/636
10,178,915 B1 * 1/2019 Sternlight ..... A47C 7/383
2005/0278853 A1 * 12/2005 Littlehorn ..... A47C 16/00 5/636
2006/0213012 A1 * 9/2006 Nakasato ..... A47G 9/10 5/636
2007/0131231 A1 * 6/2007 Sharp ..... A61F 5/56 128/848

(Continued)

FOREIGN PATENT DOCUMENTS

GB 2194883 A * 3/1988 ..... A47C 7/383

*Primary Examiner* — Justin C Mikowski
*Assistant Examiner* — George Sun
(74) *Attorney, Agent, or Firm* — TMB Law; Timothy M. Brown

(57) ABSTRACT

The invention provides a travel pillow that is adapted to rest the head of a user upon the chest. The inventive travel pillow comprises a pillow member that is adapted to be positioned beneath the chin of the user. The pillow member is coupled to securing members that use the weight of the user in a seated position to maintain the pillow member in a desired position beneath the chin of the user.

18 Claims, 5 Drawing Sheets

(56) References Cited

U.S. PATENT DOCUMENTS

| | | | | |
|---|---|---|---|---|
| 2009/0236893 | A1* | 9/2009 | Ehlers | A47C 31/005 297/391 |
| 2013/0232693 | A1* | 9/2013 | Myers | A47C 7/383 5/636 |
| 2013/0276236 | A1* | 10/2013 | Rasmussen | A47G 9/1027 5/636 |
| 2014/0310877 | A1* | 10/2014 | Sternlight | A47G 9/02 5/639 |
| 2015/0020314 | A1* | 1/2015 | Garcia | A47C 7/383 5/636 |
| 2015/0257538 | A1* | 9/2015 | MacDougall | B60N 2/882 297/217.1 |
| 2015/0351564 | A1* | 12/2015 | Vogel | A47G 9/1054 5/640 |
| 2016/0007756 | A1* | 1/2016 | Hauer | A47G 9/1081 5/636 |
| 2016/0303454 | A1* | 10/2016 | Balent | A63B 71/0622 |
| 2017/0156519 | A1* | 6/2017 | Cheng | A47C 7/383 |
| 2018/0368593 | A1* | 12/2018 | Bourgeois | A47G 9/1009 |
| 2019/0335905 | A1* | 11/2019 | Alexander | A61H 15/00 |

* cited by examiner

TRAVEL PILLOW FOR RESTING THE HEAD UPON THE CHEST

FIELD OF THE INVENTION

The invention generally relates to travel pillows. More particularly, the invention relates to a travel pillow and method for resting the head of a user upon the chest.

BACKGROUND OF THE INVENTION

Pillows for use during travel are known in the art. Among such pillows is a pillow having a semi-circular configuration. This pillow is positioned around the user's neck, with the open portion of the semi-circle being oriented toward the front of the user. While this pillow can support the head from the back and sides, it fails to support the head from the front. Thus, the pillow is incapable of preventing the head from tilting forward during sleep which leads to discomfort, the disruption of rest, and cramping and soreness in the user's neck and back. The failure of the pillow to support the head from the front also eliminates a sleeping position wherein the head is maintained upright by resting the head upon the chest. This can be particularly problematic when the user is seated between two adjacent seats, such as on an airplane, where resting the head to the side is not an option. Another disadvantage of the semi-circular pillow is that it wraps around the neck. Thus, the semi-circular pillow is confining and traps heat against the user's neck.

Another contemporary travel pillow comprises a pillow with an attaching strap that wraps around the backrest of a seat. Like the semi-circular pillow, this pillow permits the user's head to bow downward during sleep leading to discomfort, the disruption of rest, and back and neck pain. The pillow with attaching strap also fails to provide the user with a sleeping position wherein the head is maintained upright with the head resting on the user's chest. Like the semi-circular pillow, the pillow with attaching strap is also impractical for use between adjacent seats.

What is needed in the art therefore is a travel pillow that provides a sleeping position wherein the user's head is maintained upright with the head resting upon the chest, while avoiding confinement and the trapping heat against the user's neck.

SUMMARY OF THE INVENTION

The invention provides a first of-its-kind travel pillow that is adapted to rest the head of a user upon the chest, while avoiding the confinement of, and trapping heat against, the user's neck. The inventive pillow also provides a means for assuming a comfortable resting position when a user is positioned next to between adjacent seats, such as during travel on an airplane.

The inventive travel pillow incorporates a pillow member that is adapted to support the user's head upon the chest. The inventive travel pillow further incorporates securing members that make it possible for the pillow member to remain in a position where it can support the user's head upon the chest.

Figure 1:
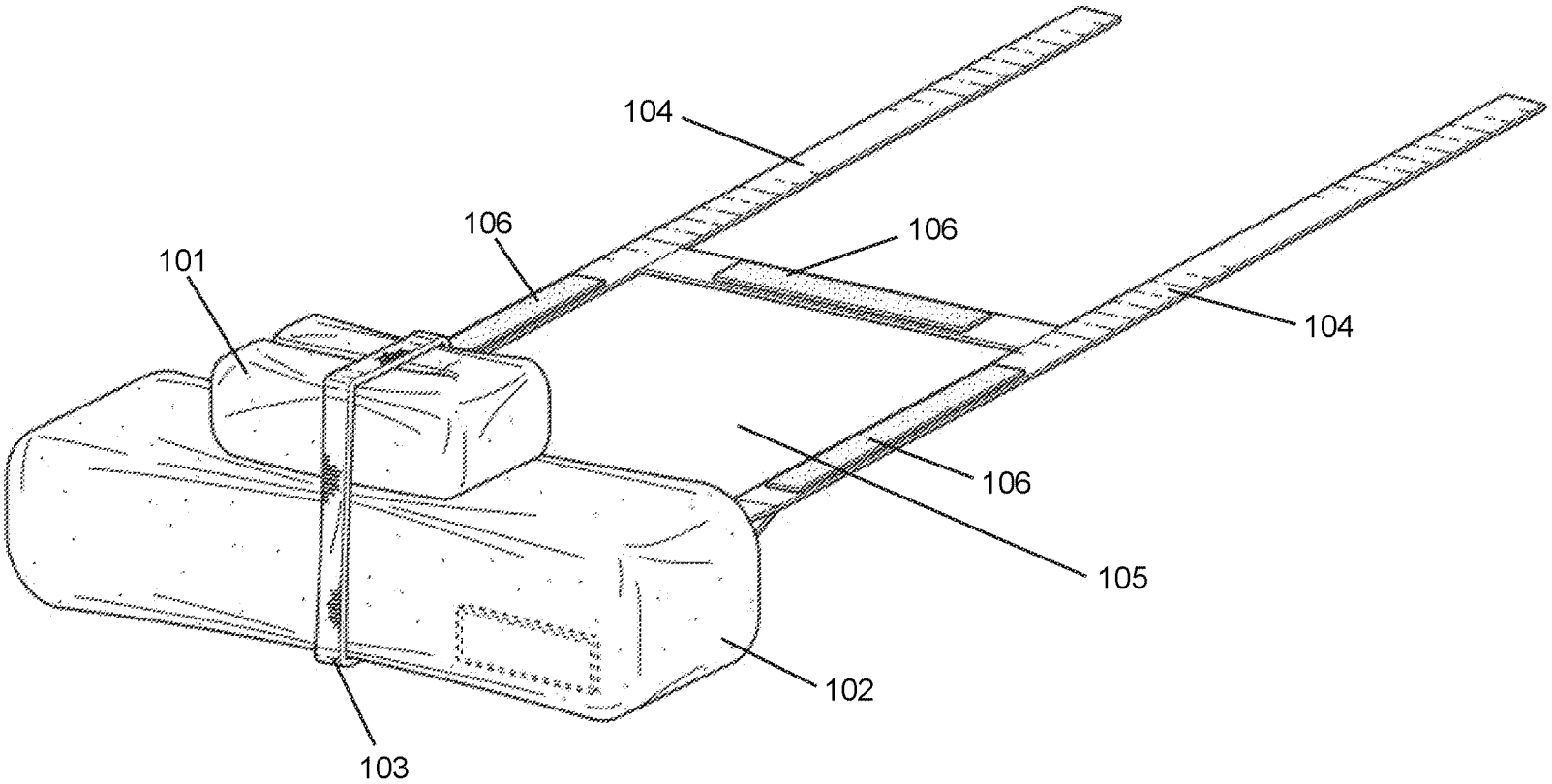
FIG. 1 shows a perspective view of an embodiment of the inventive travel pillow.

The figures referred to above are not drawn necessarily to scale and should be understood to present a representation of the invention, illustrative of the principles involved. Some features of the travel pillow depicted in the drawings have been enlarged or distorted relative to others to facilitate explanation and understanding. The same reference numbers are used in the drawings for similar or identical components and features shown in various alternative embodiments. The travel pillow, as disclosed herein, will have configurations and components determined, in part, by the intended application and environment in which it is used.

DETAILED DESCRIPTION

The invention provides a travel pillow for resting the user's head upon the chest. The inventive travel pillow prevents the user's head from bowing downward during rest in a manner that would otherwise produce discomfort, pain and cramping in the neck and back, and the disruption of rest. The inventive travel pillow also provides a user with a sleeping position wherein the head is maintained upright so that the user can assume a resting position between, or next to, adjacent seats, such as on an airplane.

FIG. 1 shows an embodiment of the inventive travel pillow comprising a pillow member. The pillow member can include chin portion 101 and chest portion 102. Chin portion 101 is adapted to provide a support for receiving the chin of a user, while chest portion 102 is adapted to rest upon the chest of the user. Chin portion 101 and chest portion 102 can together, or individually, assume a typical pillow configuration wherein a shell encloses a filling material. Suitable materials for the shell include, but are not necessarily limited to, cotton, wool, microfiber, linen, satin, silk, nylon, polyester, bamboo, flannel, and the like. Suitable filling materials for chin portion 101 and chest portion 102 include, but are not necessarily limited to one or more of foams (e.g. memory foam), down, down alternative, feathers, gels, buckwheat hulls, rice, lavender, microbeads, shredded latex, kapok, wool, cotton, polyester (e.g. polyester fiber film), and the like. While chin portion 101 is depicted as being smaller than chest portion 102, it will be appreciated that chin portion 101 can be similar in size to, or the same size as, chest portion 102. It will further be appreciated that chin portion 101 and chest portion 102 can comprise a single shell that encloses a filling material. In such embodiments, the filling material may comprise a single, continuous material, such as a foam or gel bock or other shape, for example. Chin portion 101 can have a groove therein for receiving and nestling the chin of a user. In some embodiments, the pillow member includes a removable cover that is suitable for washing, such as by machine washing. The removable cover can be adapted to cover chin portion 101, chest portion 102, or a combination thereof. Suitable materials for the removable cover include, but are not necessarily limited to, cotton, wool, microfiber, linen, satin, silk, nylon, polyester, bamboo, flannel, and the like.

Figure 2:
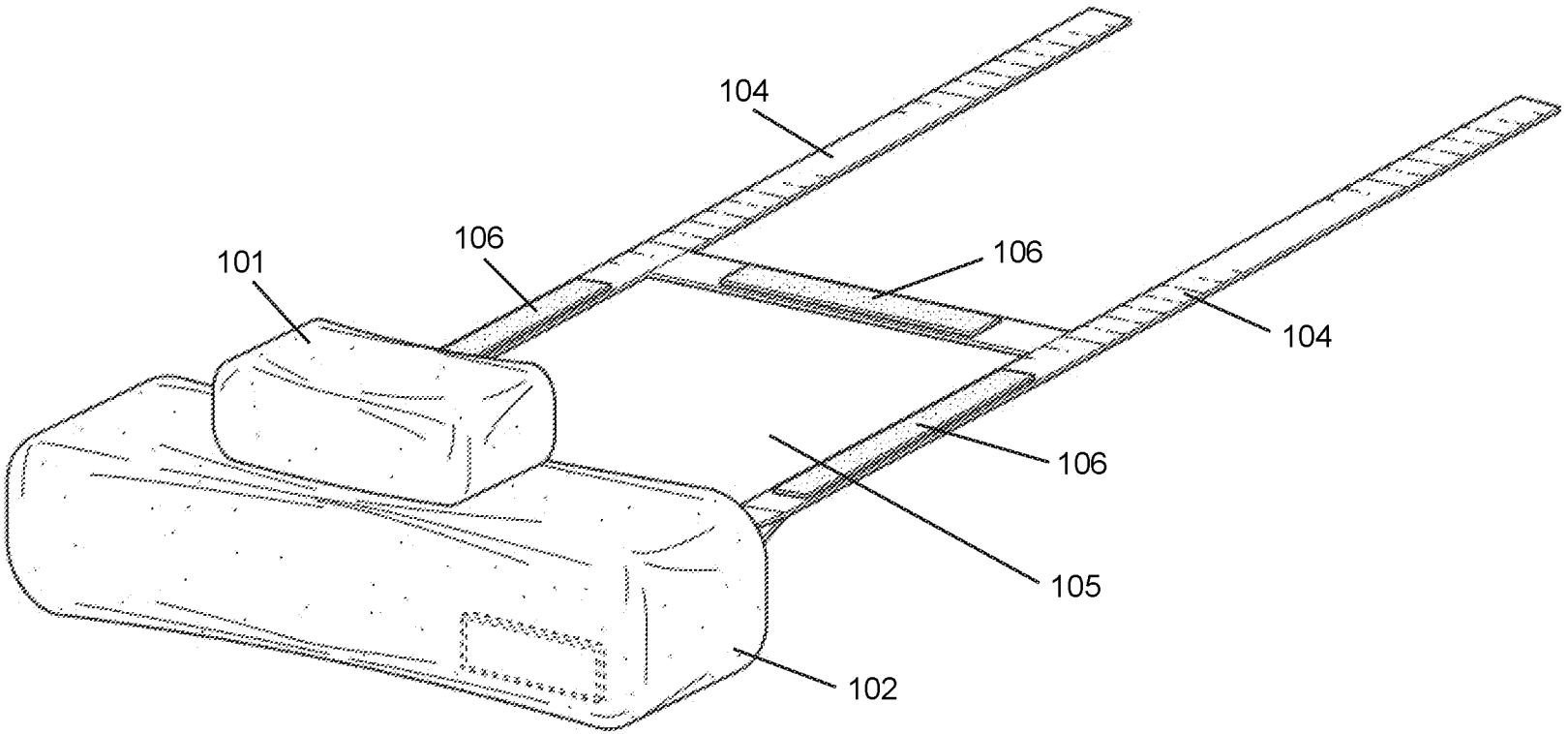
FIG. 2 shows a perspective view of an alternate embodiment of the inventive travel pillow.

Chin portion 101 can be coupled to chest portion 102 by elongate coupling member 103. Elongate coupling member 103 can be an elastic strap or loop that holds chin portion 101 against chest portion 102 under tension. Alternatively, elongate coupling member 103 can be made from a soft, supple material such as a fabric strap, wherein the strap is tied around chin portion 101 and chest portion 102. FIG. 2 depicts an alternative embodiment of the inventive travel pillow wherein the pillow member comprises chin portion 101 coupled to chest portion 102 by a means, such as sewing, hook and loop fasteners (e.g. Velcro™), buttons, snaps, a zipper, or combinations thereof, for example. In some embodiments, chin portion 101 is folded upon itself and coupled to chest portion 102 as disclosed herein. For example, chin portion 101 can be a pillow that is folded upon itself and coupled to chest portion 102 by elongate coupling member 103, wherein elongate coupling member 103 is a fabric strap that is tied around chin portion 101 and chest portion 102. In embodiments where chin portion 101 is formed from a pillow that is folded upon itself, the folded pillow can form a groove for receiving and nestling the chin of a user.

The inventive travel pillow comprises securing member 104 coupled to the pillow member, wherein securing member 104 comprises opening 105. In some embodiments, securing member 104 is coupled to chest portion 102. Securing member 104 can comprise two or more elongate straps that are connected to chest portion 102. Securing member 104 can comprise two or more elongate straps that are not joined to one another. Alternatively, securing member 104 can comprise two or more elongate straps that are joined to one another by one or more cross members. Alternatively, securing member 104 can be a planar sheet coupled to the pillow member, wherein the planar sheet comprises opening 105 positioned near the pillow member. Securing member 104 can be made of a supple material such as nylon or cotton webbing, fabric, or canvas, for example. Securing member 104 can be coupled to the pillow member by sewing, hook and loop fasteners (e.g. Velcro™), buttons, snaps, a zipper, or combinations thereof, for example.

Opening 105 is adapted to receive the head of a user and permit the inventive travel pillow to be installed upon a user by the user inserting their head through opening 105 such that the lower surface of securing member 104 rests against the back of the user.

Securing member 104 can comprise one or more friction elements 106 on at least a portion of the upper surface of securing member 104. Friction elements 106 are adapted to produce friction between securing member 104 and the surface of the backrest of a seat that is occupied by a user when the inventive pillow is installed upon the user. Friction elements 106 can be attached to securing member 104 by sewing, an adhesive, or a combination thereof, for example. Friction elements 106 can be any suitable material that is capable of producing friction with the backrest of a seat. Suitable materials for friction elements 106 include, but are not limited to, rubber and silicone, for example. Friction elements 106 can include features, such as knurling, projections, or other uneven surface, that enhance the ability of friction elements 106 to produce friction when contacted with the backrest of a seat. Friction elements 106 can similarly comprise the hook material from a hook-and-loop fastener (e.g. Velcro™). In an alternate embodiment, securing member 104 can be made entirely from a material such as silicone or rubber so that securing member forms a single, continuous material suitable for producing friction between securing member 104 and the backrest of a seat that is occupied by the user.

Figure 3:
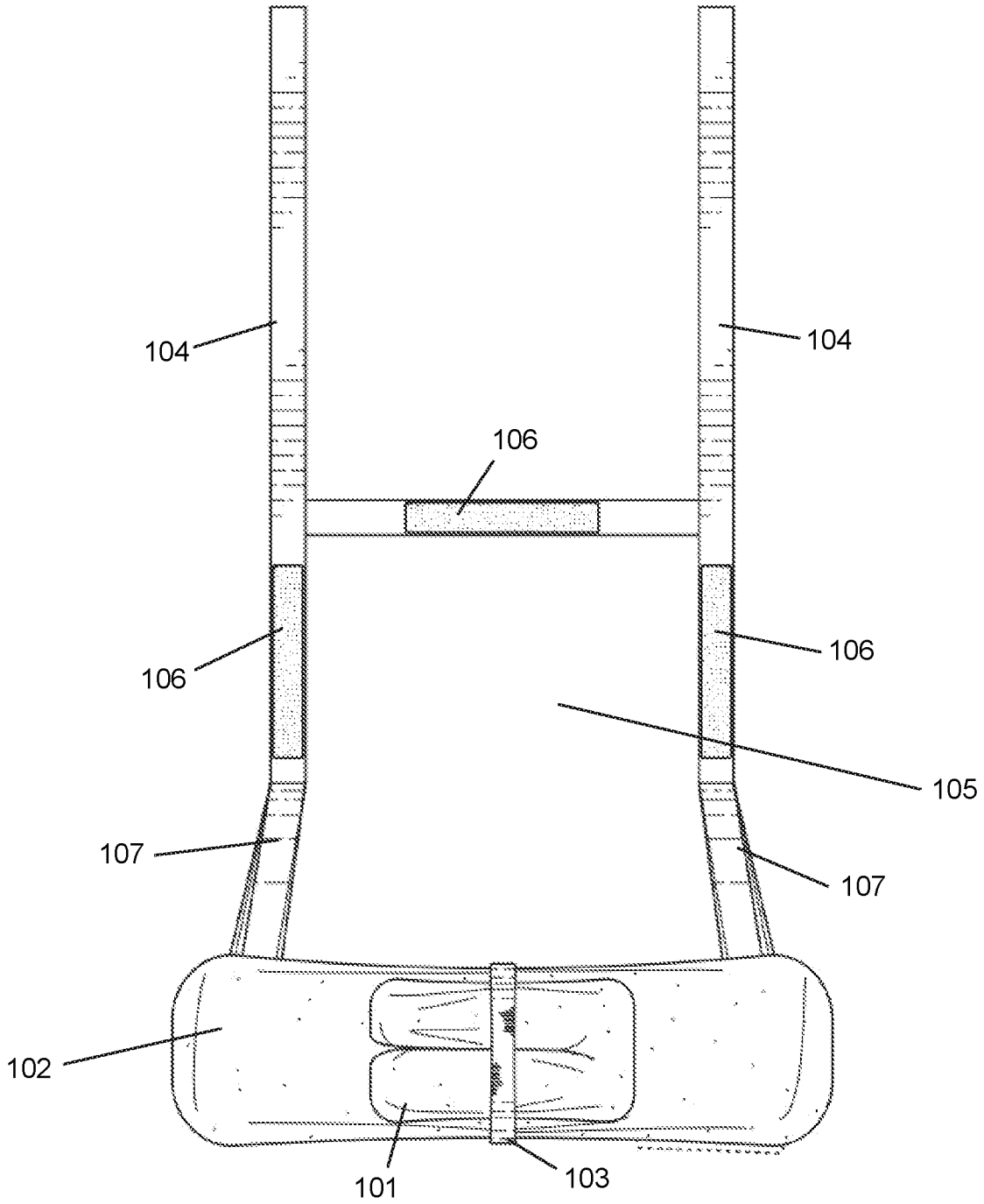
FIG. 3 shows a plan view of the travel pillow of FIG. 1.
Figure 4:
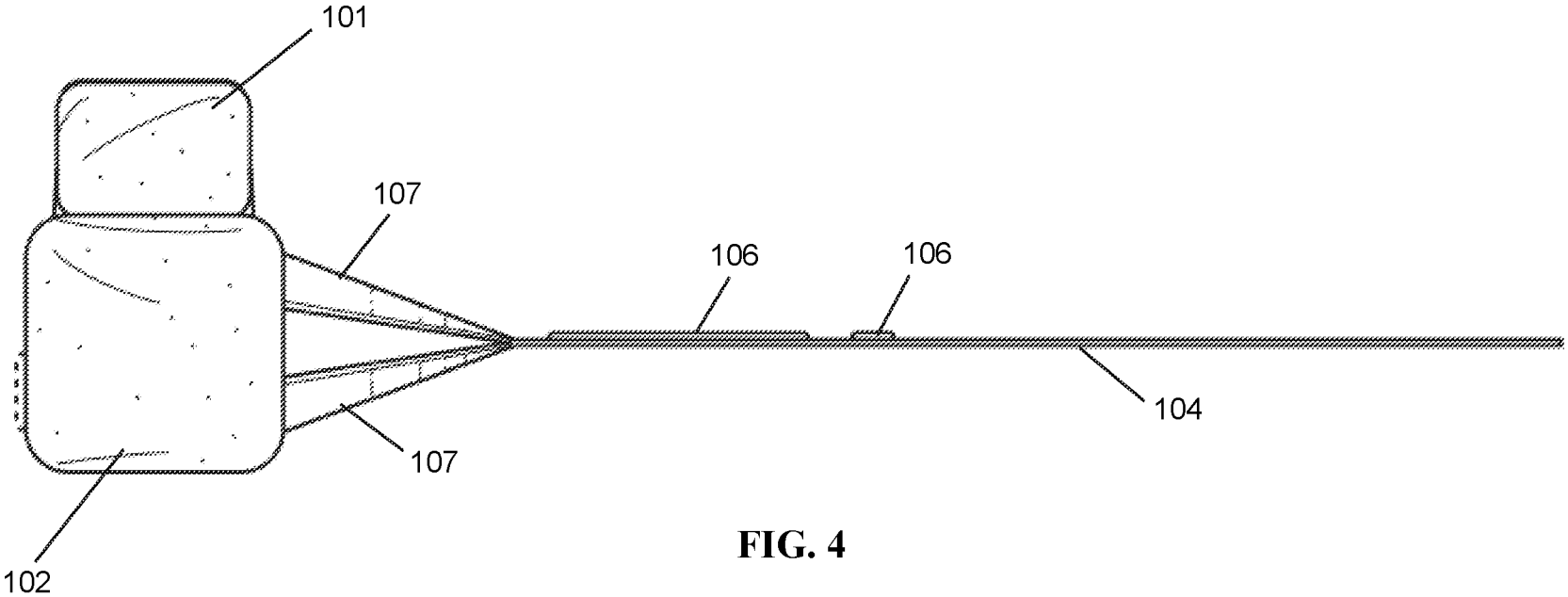
FIG. 4 shows a side view of an embodiment of the inventive travel pillow.

FIGS. 3 and 4 shows an embodiment of the inventive travel pillow wherein securing member 104 is coupled to chest portion 102 by coupling elements 107. Coupling elements 107 can be a pair of supple straps that connect at or near opposing ends of chest portion 102. Using a pair of straps for coupling elements 107 can provide a stabilizing effect by securing the top and bottom of chest portion 102 to securing member 104 so as to prevent the rotation of the pillow member such that chin portion 101 remains properly positioned under the chin of a user when the inventive travel pillow is installed upon the user with securing members 104 being pressed against the seatback of a seat when the user is in a seated position. Coupling elements 107 can be straps made of a fabric material, wherein coupling elements 107 are coupled to chest portion 102 by sewing, hook and loop fasteners (e.g. Velcro™), buttons, snaps, a zipper, or combinations thereof, for example. Suitable materials for coupling elements 107 include, but are not necessarily limited to, nylon or cotton webbing, fabric, canvas, or combinations thereof.

Figure 5:
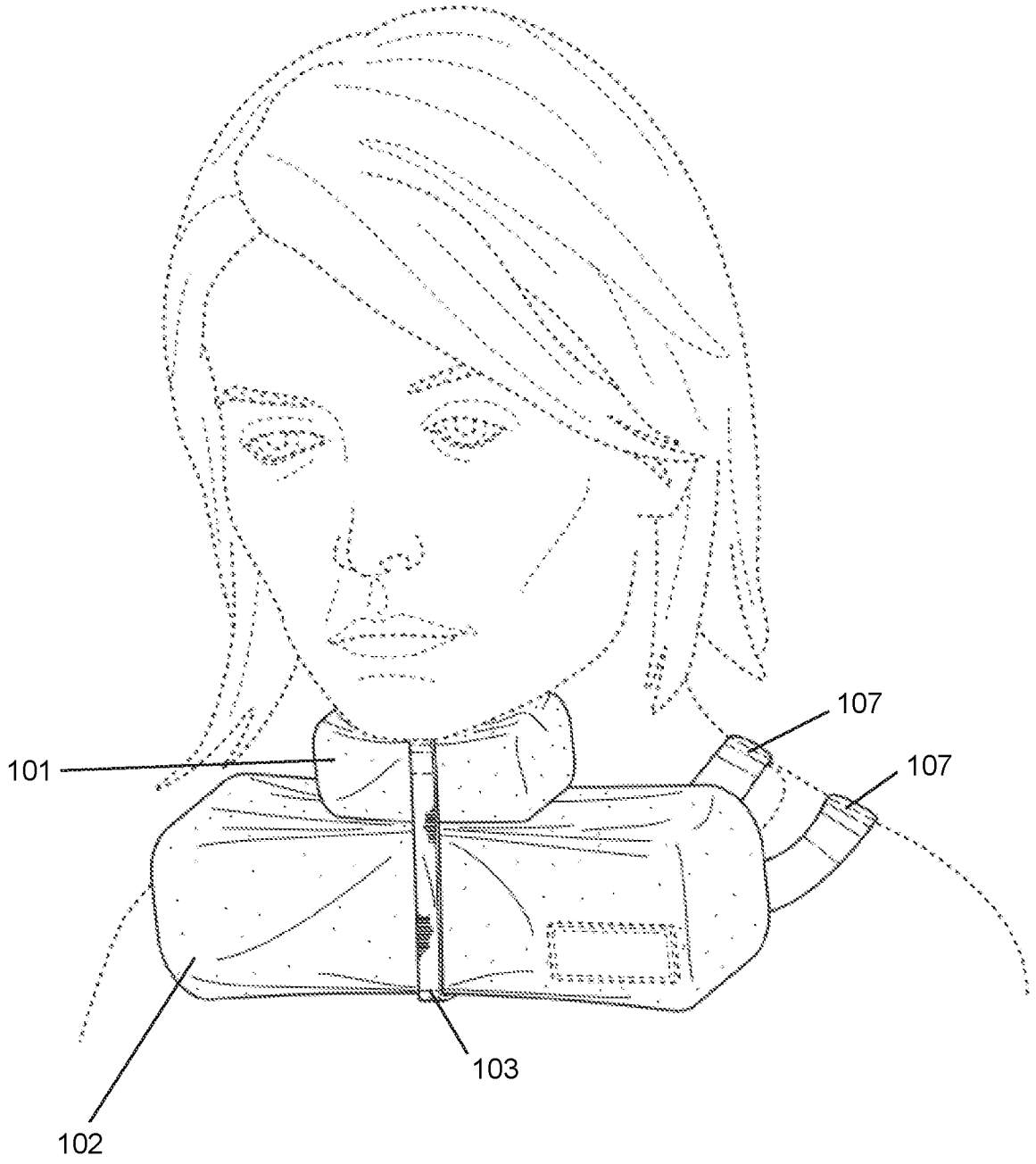
FIG. 5 shows an embodiment of the inventive travel pillow installed upon a user.

FIG. 5 shows an embodiment of the inventive travel pillow installed upon a user, wherein chin portion 101 is in contact with the user's chin and chest portion 102 is resting upon the user's chest. With the travel pillow engaged in this manner, the head of the user is supported upon the chest and prevented from tilting downward so that the user's head is maintained in a comfortable, upright position.

The inventive travel pillow can be used in a manner wherein a user places their head through opening 105 such that the lower surface of securing member 104 lays against the user's back. The pillow member is then positioned beneath the user's chin so that the user can assume a desired resting position for the head wherein the user's chin contacts chin portion 101 and the user's head rests upon the chest. Moving the pillow member toward and away from the chin allows the user to assume a desired angle for the downward position of the user's head.

The pillow member can be positioned beneath the user's chin by the user reaching behind their back and pulling downward on securing member 104. Alternatively, the user can grasp and position the pillow member to a desired position, while allowing the weight of securing member 104 to straighten securing member 104 so that it lies at least essentially straight upon the user's back. With the inventive travel pillow so installed, the user then rests their back against the seatback of a seat so that the weight of the user presses securing member 104 against the surface of the seatback. Pressing securing member 104 against the surface of the seatback allows securing member 104 to maintain the pillow member in a desired position beneath the chin of the user as securing members 104 prevent the pillow from migrating away from the user's chin due to forces such as the weight of the user's head upon the pillow member, the user's movement, or the weight of the pillow member itself. In embodiments wherein securing member 104 comprises friction elements 106, friction elements 106 provide additional friction so as to increase the ability of securing member 104 to maintain the pillow member in a desired position.

REFERENCE CHARACTERS

101—Chin Portion
102—Chest Portion
103—Elongate Securing Member
104—Securing Member
105—Opening
106—Friction Elements
107—Coupling Elements

The invention claimed is:

1. A travel pillow for resting a head of a user upon a chest, comprising:

a) a pillow member; and b) a securing member coupled to the pillow member, wherein the securing member comprises (i) a first elongate strap, (ii) a second elongate strap, and (iii) a cross member strap, wherein: the first elongate strap and second elongate strap each have a first end and a second end; the cross member strap joins the first elongate strap to the second elongate strap between the first ends and the second ends; the first elongate strap, the second elongate strap and the cross member strap form an opening that is adapted to permit a user to insert their head through the opening; and the first elongate strap and second elongate strap are adapted to run vertically along a back of a user when the travel pillow is installed upon a user.

2. The travel pillow of claim 1, wherein the securing member comprises one or more friction elements that are adapted to resist movement of the securing member against a surface.

3. The travel pillow of claim 2, wherein the one or more friction elements comprise a material selected from rubber, silicone, and a combination thereof.

4. The travel pillow of claim 1, wherein the first elongate strap and the second elongate strap are coupled to the pillow member by coupling elements.

5. The travel pillow of claim 4, wherein the coupling elements comprise a pair of straps.

6. The travel pillow of claim 1, wherein the cross member strap comprises one or more friction elements.

7. The travel pillow of claim 6, wherein the one or more friction elements comprise a material selected from rubber, silicone, and a combination thereof.

8. The travel pillow of claim 4, wherein the coupling elements are coupled to the pillow member at or near opposing ends of the pillow member.

9. The travel pillow of claim 1, wherein the pillow member comprises a chest portion that is adapted to rest on the chest of a user, and a chin portion that is adapted to support a chin of a user.

10. The travel pillow of claim 9, wherein the chest portion is coupled to the chin portion by an elongate coupling member.

11. The travel pillow of claim 10, wherein the elongate coupling member is a strap that is tied around the chest portion and the chin portion.

12. The travel pillow of claim 9, wherein the chest portion is coupled to the chin portion by sewing, hook-and-loop fasteners, buttons, snaps, a zipper, or combinations thereof.

13. The travel pillow of claim 9, wherein the chest portion and the chin portion comprise a single, continuous material.

14. The travel pillow of claim 1, further comprising a cover that is adapted to cover at least a portion of the pillow member.

15. The travel pillow of claim 14, wherein the cover is removable.

16. The travel pillow of claim 9, further comprising a cover that is adapted to cover the chin portion.

17. The travel pillow of claim 16, wherein the cover is removable.

18. The travel pillow of claim 4, wherein the coupling elements are v-shaped straps.

* * * * *